United States Patent [19]

Maxfield

[11] Patent Number: 4,474,833

[45] Date of Patent: Oct. 2, 1984

[54] METHOD FOR CONSTRUCTING ALL-WEATHER SURFACE

[75] Inventor: Marvin L. Maxfield, Wichita, Kans.

[73] Assignee: Seal-Flex, Inc., El Dorado, Kans.

[21] Appl. No.: 410,265

[22] Filed: Aug. 23, 1982

[51] Int. Cl.[3] ..... B05D 5/10; E01C 5/12

[52] U.S. Cl. ..... 427/138; 427/203; 427/379; 427/393.6; 427/407.1; 427/421

[58] Field of Search ..... 427/138, 139, 203, 379, 427/407.1, 385.5, 403, 393.6, 421; 404/82, 32, 31, 19; 405/258, 264, 266; 272/3

[56] References Cited

U.S. PATENT DOCUMENTS

| | | | |
|---|---|---|---|
| 3,253,521 | 5/1966 | Endres | 427/138 |
| 3,446,122 | 5/1969 | Raichle et al. | 272/3 |
| 3,778,397 | 12/1973 | Gannon et al. | 427/138 |
| 3,891,585 | 6/1975 | McDonald | 404/32 |
| 3,993,412 | 11/1976 | Drane | 404/82 |
| 4,082,888 | 4/1978 | Portin | 404/32 |
| 4,341,836 | 7/1982 | Becker et al. | 427/203 |

*Primary Examiner*—S. L. Childs

*Attorney, Agent, or Firm*—Kokjer, Kircher, Bradley, Wharton, Bowman & Johnson

[57] ABSTRACT

A method for constructing an activity surface comprising a plurality of binder coatings interspersed with layers of particulate rubber. The first two binder coatings are of diluted emulsified asphaltic material to establish a good bond to the underlying foundation material. Subsequent binder coatings are of a styrene butadiene and water mixture with a small quantity of surfactant added to enhance the penetration of the coating. A sealing coat is applied to seal the upper surface and to mechanically screen the harmful effects of sunlight. Each coating of diluted styrene butadiene is permitted to dry before applying a subsequent layer of rubber particles.

21 Claims, No Drawings

METHOD FOR CONSTRUCTING ALL-WEATHER SURFACE

This invention pertains to activity surfaces and more particularly, to an all-weather surface to be used for running tracks, playgrounds, ball field warning tracks, sidewalks and the like.

Surfaces which permit activities to take place in all kinds of weather are highly desirable and an increasing demand for them has been experienced. In the past, many activities, particularly athletic events, were carried out on turf, dirt or cinder fields or tracks, but such materials were subject to radical changes under the influence of rain or other adverse weather conditions. These changed conditions often either influenced the outcome of the event or forced cancellation of the event entirely. Surfaces constructed from materials not so subject to weather influences have been restored to in order to reduce or eliminate the adverse effect of inclement weather on the scheduling and performance of such events.

Various materials and methods have been utilized in an effort to provide all-weather surfaces of this type. Typically, the materials tried for this purpose have involved some type of rubber ingredient to provide a measure of resiliency and to provide a certain amount of anti-slip quality to the surface. The rubber is often in particulate form and is mixed with a binder such as some form of asphaltic material.

While the materials and methods heretofore utilized have demonstrated the advantages which can be achieved with the installation of all-weather surfaces, certain drawbacks have been identified. Primarily the heretofore available surfaces have been prone to rather rapid degradation and have required frequent maintenance and repair as well as early replacement in many cases. Often little or no bond existed between the concrete or asphaltic foundation and the resilient surface mat, subjecting the latter to stresses causing early deterioration. The physical shape of the rubber particles used as a major constituent in the mat has sometimes resulted in a weaker than necessary composite surface. The steps taken to effect inter-particulate bonding have not been such as would produce optimum results. Most such surfaces are exposed to sunlight and inadequate protection from ultra violet degradation has led to early surface deterioration.

Accordingly, it is a primary object of the present invention to provide a method for constructing surfaces of this type which have improved characteristics and are highly durable and do not require excessive maintenance procedures.

In the achievement of the foregoing object it is an important object of the present invention to provide a construction process wherein a desirable bond is achieved between the activity mat and the surface of the underlying foundation.

A yet further object of the invention is to provide a method wherein an improved bond is achieved between the discrete rubber particles of the mat so that the structural integrity and durability of the mat is enhanced.

Still another object of the present invention is to provide a process wherein the susceptibility of the materials to the deleterious effects of sunlight are substantially decreased.

These and other aims and objectives of the present invention will be further explained or will become apparent from the following description and explanation of the invention.

The surface or mat contemplated by this invention is constructed over a firm base or foundation having a relatively smooth upper surface. The foundation may be of concrete construction or it may be made of asphaltic material. The construction of this foundation is conventional, forms no part of the present invention and need not be further described except to point out that new concrete should be allowed to cure at least seven days before initiating the mat construction.

The first step in constructing the mat pursuant to the method of this invention is to spread uniformly over the foundation surface an asphaltic tack coating material comprising an emulsified asphalt diluted approximately 50% by water. An emulsified asphalt of the type designated in the trade as type SS1H has been found satisfactory for this purpose. The rate of application of the tack coating should be no less than 0.2 gallons per square yard of surface.

The next step in constructing the mat is to spread uniformly over the tack coating a layer of rubber particles in the quantity of about two pounds of particles per square yard of surface. The rubber material may be of any suitable type for this purpose but it has been found that a particularly advantageous type of rubber is vulcanized rubber which is reclaimed as a by-product from the recapping of used vehicle tires. Further, the best rubber for mat construction is the type known as "strand" rubber which is stripped from the tire carcass by a process wherein the tire is rotated and elongated strips of rubber are cut from the tire thread. While rubber pellets derived merely from grinding reclaimed tire rubber may be utilized for mat construction, the elongated shape of the rubber particles derived from the rubber "stranding" process has been found to be best suited for this purpose.

Whether or not strand rubber is utilized in the mat construction, the sizes of the particles should be within certain predetermined limits. All rubber layers in the mat except the final or top layer should be of such sizes that 100% of the particles are retained on a 16 mesh screen and 100% of the particles pass a $\frac{3}{8}$ inch mesh screen. When strand rubber is utilized, the size gradations can be achieved by subjecting the strands to a further grinding process. It will be understood, of course, that the gradation of the rubber particles have a direct bearing on the final texture of the mat. The particular gradation may be altered within the foregoing limits as desired to achieve the texture sought.

After the rubber particles are uniformly spread over the tack coating, a second coating of the same material as is used for the tack coating is sprayed over this layer of rubber particles at a rate of not less than 0.3 of a gallon of the material per square yard. This second coating of emulsified asphaltic material is followed by a second layer of rubber particles spread uniformly over the surface at a rate of approximately two pounds per square yard. The rubber particles of the second coat are integrated down into and fill the voids between the rubber particles of the first layer. Further, the asphalt binder not only binds the first two layers of rubber together, but also bind the mat to the foundation material.

The next step in the mat construction process involves the spraying of a liquid mixture containing styrene butadiene over the proceeding rubber layers in sufficient quantity to coat substantially all rubber particles with the mixture. The styrene butadiene material (commonly termed latex) found suitable for this purpose is a material containing 50% solids by weight such as is manufactured and sold by Union Chemical Company under the trade name Amsco Resin 4170. This material is diluted or cut back from approximately 30% to approximately 50% by water to increase the penetrating capability of the material and to insure that all rubber particles of the previously applied layers of rubber are coated with the material. It has been found desirable for many applications to add a quantity of surfactant to the mixture to further enhance the penetrating capabilities. Any suitable surfactant may be used such as polyethylene glycol, low sudsing detergent or ammonia will suffice, ordinary low sudsing dish washing detergent added to the mixture in a ratio of approximately 1 cup of detergent to 55 gallons of the mixture has provided beneficial results.

The application of the styrene butadiene and water mixture is followed by air drying of this material to a point where no visible water is left in the mat. A test to determine whether or not sufficient drying or curing has taken place may be accomplished by impressing the mat with a force of approximately 50 pounds per square inch and observing whether or not visible moisture is present as a result of this squeezing pressure. The time for sufficient drying or curing to occur will vary depending upon the temperature and humidity conditions present. The required interval will vary from approximately one hour on hot, dry days to as much as 12 hours on cold, humid days.

Once the latex coating is sufficiently dried, a subsequent layer of rubber particles is applied to the mat. The rubber is spread uniformly over the surface, again at a rate of approximately two pounds per square yard and another coating of the styrene butadiene and water mixture is sprayed over this layer of particles and allowed to dry before a further layer of rubber particles is applied.

The process of sequentially applying the rubber particles, spraying the latex and water mixture over the particles, followed by air drying is repeated in this sequence until the approximate desired thickness of the mat is achieved. Usually the thickness of the final mat will be from about ¼ to ½ inch for most applications.

It has been found desirable to apply the latex and water mixture by means of spraying equipment wherein the liquid is sprayed over the rubber layers at a pressure of between 10 pounds per square inch to about 40 pounds per square inch. These pressures are sufficient to slightly agitate and "settle" the rubber particles into the integrated mass while insuring a thorough coating of substantially each rubber particle during the process. The quantity of this liquid which is applied during each coating step may vary but should be sufficient to insure that all rubber particles which have previously been applied to the mat are coated with the liquid during each application.

It is often a requirement for the construction of mats or surfaces of this type that a particular coloration shall be effected. For this purpose, color pigment is mixed with the latex and water liquid. In some cases, it will be sufficient to include the color pigment only in the final one or two coatings of the latex mixture. On the other hand, if it is desired that the color be present throughout the mat, the color pigment is included in all applications of the latex liquid. The pigment not only serves to provide the ultimate color desired, but it also functions as a mechanical screen to protect the material of the mat from the degrading effects of ultra violet radiation.

Normally, it is desired to provide a somewhat finer texture for the upper surface of the mat. Accordingly, the final layer of rubber applied over the last coating of latex and water mixture should be of finer gradation. For this purpose, the final top coat of rubber is screened so that 100% of the material is retained on a 16 mesh screen and 100% of the material passes a ⅛ inch mesh screen. If a black color is desired for the mat, the final liquid binder applied to the mat may be any one of a number of commercially available coal tar and pitch emulsions such as are commonly termed driveway or parking lot sealers. This coal tar material is cut back with water in a sufficient amount to allow total penetration when applied over the surface of the mat down through the various layers of the mat to the tack coating. The black color of this coal tar material is sufficient to provide a good mechanical screen against ultra violet degradation. On the other hand, if the final color of the mat is to be something other than black, the appropriate color pigmentation is mixed with styrene butadiene and water material of the same type as is used in the binder coatings. The material is sprayed as a seaing coat over the upper layer of rubber particles. Again, the quantity administered in the sealing coat should be sufficient to allow penetration completely through the mat layers. A particularly popular color for mats to serve as activity surfaces of the type contemplated by this invention is the reddish brown color achieved by utilizing iron oxide as the color pigmentation. It will be understood by those skilled in the art, however, that other types of good color pigments may be utilized if desired.

It has been found that mats constructed pursant to the foregoing principles are significantly more durable than those which have heretofore been available. Maintenance procedures are usually not required until the expiration of approximately three to five years from the original mat construction. When maintenance is needed, it is a simple manner to spray styrene butadiene and water over the surface and add rubber particles as required to return the mat to its previous condition of serviceability. Normally, it is not necessary to tear the surface up and replace it. Further, the areas of greatest traffic can be rejuvenated by this process without the necessity for reconstructing the entire mat.

I claim:

1. A method for constructing an activity mat over a foundation comprising the steps of:

spreading an asphaltic tack coating over the foundation surface;

spreading a first uniform layer of particulate rubber over the tack coating;

spreading a second asphaltic coating over the first layer of rubber;

spreading a second uniform layer of particulate rubber over said second asphaltic coating;

then, in sequence, first applying a liquid mixture containing styrene butadiene and water to the preceding rubber layers in sufficient quantity to coat substantially all rubber particles of said layers then air drying said applied mixture until substantially no liquid is visible, then spreading a succeeding uniform layer of particular rubber uniformly over the preceding layers;

continuing the aforesaid sequential application of styrene butadiene and water mixture, air drying and spreading of uniform layers of rubber until the approximate desired thickness for the mat is achieved; and applying a coat of sealing material over the top layer of rubber particles.

2. The invention of claim 1, wherein said tack and second coatings are of emulsified asphalt material.

3. The invention of claim 2, wherein said emulsified asphalt is diluted by the addition of about 50% water to the emulsified asphalt to enhance the penetrating characteristics of the material.

4. The invention of claim 1, wherein the quantity of particulate rubber of each rubber layer is about 2 pounds per square yard.

5. The invention of claim 1, wherein the sizes of the rubber particules in the uppermost layer of rubber of the mat are finer than the particle sizes of one or more of the preceding layers of rubber.

6. The invention of claim 5, wherein the particle sizes of the rubber for one or more of the subsurface layers or rubber are such that 100% of the particles are retained on a 16 mesh screen and 100% pass a $\frac{3}{8}$ inch mesh screen.

7. The invention of claim 6, wherein the particle sizes of the rubber for the uppermost layer of rubber are such that 100% of the particles are retained on a 16 mesh screen and 100% pass a $\frac{1}{8}$ inch mesh screen.

8. The invention of claim 2, wherein said asphalt is type SS1H emulsified asphalt.

9. The invention of claim 8, wherein the emulsified asphalt for the tack coat is applied at a rate of not less than about 0.2 gallon per square yard of surface.

10. The invention of claim 9, wherein said second asphalt coat is applied at a rate of not less than about 0.3 gallon per square yard of surface.

11. The invention of claim 1, wherein the styrene butadiene contains approximately 50% solids by weight.

12. The invention of claim 11, wherein a color pigment is added to the styrene butadiene which is applied to at least one layer of rubber particles prior to the application thereof.

13. The invention of claim 12, wherein said color pigment is $FeO_2$.

14. The invention of claim 11, wherein a surfactant is added to the styrene butadiene and water mixture to enhance the penetrating characteristics of the mixture.

15. The invention of claim 14, wherein the surfactant is a low sudsing detergent.

16. The invention of claim 15, wherein the detergent is added in a quantity of about one cup of detergent to 55 gallons of said mixture.

17. The invention of claim 1, wherein the rubber particles are strands of rubber removed from vulcanized tire carcasses by a stripping process, and wherein the strands are ground to a predetermined size gradation.

18. The invention of claim 1, wherein a sealing coat of rubberized coal tar emulsion sealer and water material is applied uniformly over the mat following application of the uppermost coating of styrene butadiene and water mixture, whereby to protect the mat from weather and ultra violet degradation.

19. The invention of claim 18, wherein said sealer and water material is applied in sufficient quantity to permit total permeation of the material throughout all previously applied layers of the mat.

20. A process for constructing an activity mat over a foundation comprising the steps of:

spreading a tack coating comprising a mixture of about equal quantities of SS1H emulsified asphalt and water to the foundation surface at a rate of no less than 0.2 gallons of said mixture per square yard of foundation surface;

spreading uniformly over the tack coating a first layer of strand rubber praticles having sizes such that 100% of said particles are retained on a 16 mesh screen and 100% pass a $\frac{3}{8}$ inch screen, and in a quantity of about 2 pounds of particles per square yard of layer;

spraying a second coating of said emulsified asphalt and water mixture over said first layer of rubber particles at a rate of no less than 0.3 gallons of mixture per square yard of surface;

spreading successive layers of said rubber particles until the desired mat thickness is achieved with each layer being followed by the spraying of a liquid styrene butadiene containing 50% solids and diluted from about 30% to 50% with water over the immediately preceding layer of particles and in an amount sufficient to coat substantially all previously applied particles with the liquid, said liquid being permitted to dry until substantially no visible moisture is present before applying the next layer of rubber;

applying a top layer of finer rubber particles uniformly over the mat; and spraying an emulsified coal tar sealer over the top layer of particles.

21. The invention of claim 20, wherein said styrene butadiene and water liquid is sprayed over the rubber particles at pressure of from 10 to 40 pounds per square inch.

* * * * *